United States Patent [19]

Simon

[11] Patent Number: 4,700,433

[45] Date of Patent: Oct. 20, 1987

[54] DEVICE OF THE CLEVIS TYPE FOR HANDLING OPERATIONS

[76] Inventor: François Simon, "Lachat" Route de Mery, 73420 Mery par Viviers du Lac, France

[21] Appl. No.: 893,595

[22] Filed: Aug. 6, 1986

[51] Int. Cl.[4] ..... A63B 61/04; B65D 63/00

[52] U.S. Cl. ..... 24/68 B; 24/68 D; 24/71.2

[58] Field of Search ..... 24/68 R, 68 D, 68 B, 24/330, 340, 69 ST, 265 CD, 269, 71.2

[56] References Cited

U.S. PATENT DOCUMENTS

| | | | |
|---|---|---|---|
| 604,302 | 5/1898 | Clark | 24/71.2 |
| 1,467,943 | 9/1923 | Lampert | 24/269 |
| 2,563,129 | 8/1951 | Montgomery | 24/68 B |
| 2,710,998 | 6/1955 | Meighan et al. | 24/68 B |
| 3,120,040 | 2/1964 | Molzan et al. . | |
| 3,343,862 | 9/1967 | Holmes . | |
| 3,856,265 | 12/1974 | Foster | 24/68 R |
| 3,881,694 | 5/1975 | Gardner | 24/68 D |
| 4,155,537 | 5/1979 | Bronson et al. . | |
| 4,499,680 | 2/1985 | Coburn | 24/16 PB |
| 4,510,652 | 4/1985 | Van Iperen | 24/68 D |

FOREIGN PATENT DOCUMENTS

| | | |
|---|---|---|
| 1460820 | 12/1966 | France . |
| 2461675 | 2/1981 | France . |
| 2002315 | 2/1979 | United Kingdom . |

*Primary Examiner*—Victor N. Sakran
*Attorney, Agent, or Firm*—Peter L. Berger

[57] ABSTRACT

The device of the clevis type for handling materials, notably lifting or hauling operations, comprises two clevis branches connected by at least two stems which have non aligned parallel axes and at least one of which is slit longitudinally, a flat flexible tie in the form of a strap having one at least of its ends secured against motion by friction on the slit stem with the strap penetrating the associated slot and being lockingly wound on the slit stem, and means being provided for locking said slit stem in rotation about its axis.

8 Claims, 5 Drawing Figures

DEVICE OF THE CLEVIS TYPE FOR HANDLING OPERATIONS

FIELD OF THE INVENTION

This invention relates to a device of the clevis type for handling materials, for example for lifting or hauling operations.

OBJECTS AND SUMMARY OF THE INVENTION p Its object is to provide a clevis of said type which is light in weight, inexpensive and easy to use.

To this effect, the device according to the invention is characterized in that it includes: two stems having non aligned parallel axes and which are longitudinally slit; a flat flexible tie of the strap type the non treated free ends of which are each secured against motion by friction on one of said slit stems, with the strap penetrating the associated slot and being lockingly wound on the slit stem; means for defining the angular position of said slit stems about their axis; and at least a return stem freely rotatable about itself or being locked in rotation, the strap extending between two similar elements for forming a tackle.

With such a device, the strap, which can be woven or obtained from a band of plastic material, can advantageously be cut to requirement from a coil and directly used with the clevis without it being necessary to provide its ends with stitched seams, beads or the like for its fixation.

According to another feature of the invention, the locking means are arranged in such manner as to be able to occupy an inactive position in which the slit stem can rotate about itself in order to wind and lock the strap, and an active position in which it prevents said stem to rotate.

For example, said locking means can be made of a catch.

According to another feature, the device includes outer means for controlling the rotation of the slit stem, for said locking or for the variation of the strap active length.

The driving in rotation of the slit stem can be obtained for example by a polygonal profile formed at one of the ends of the stem.

In a particular embodiment, the device comprises at least two slit stems, at least one of which is locked in rotation and at least another is controlled in rotation for forming a lifting shackle.

For making a shackle, a return stem, which is slit or not, can be provided and can rotate freely about its axis.

The clevis can cooperate with a clevis of the same type for making a shackle, the strap extending between the two clevises.

BRIEF DESCRIPTION OF THE DRAWINGS

The invention will become more apparent from the following description of embodiments thereof, with reference to the accompany drawings wherein.

DETAILED DESCRIPTION OF THE INVENTION

Figure 2:
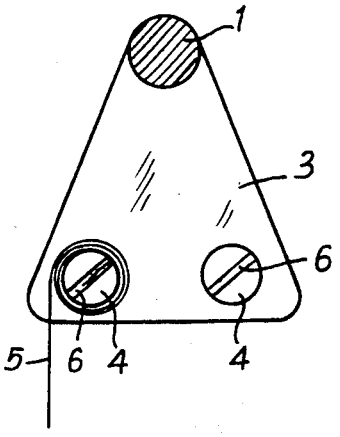
FIG. 2 is a sectional view along line II—II of FIG. 1.

The clevis shown in full lines in the drawing, according to two embodiments, includes a central core 1 and two side branches 2,3. The side branches 2,3 are flattened and flare out slightly toward their free end.

Figure 1:
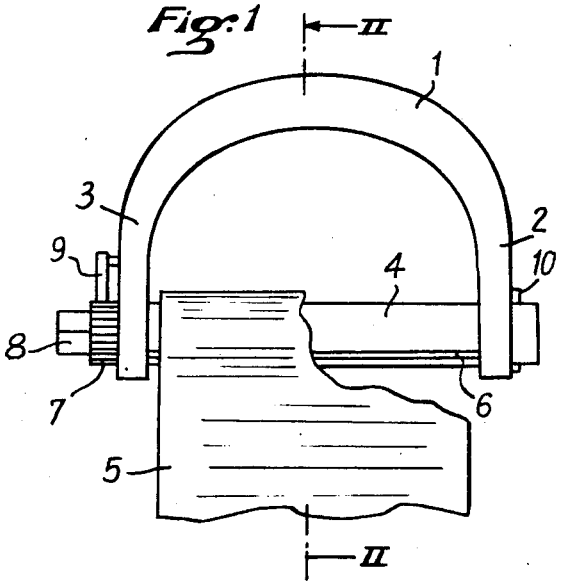
FIG. 1 is a front elevation view, with parts cut away, of a clevis accroding to the invention.
Figure 4:
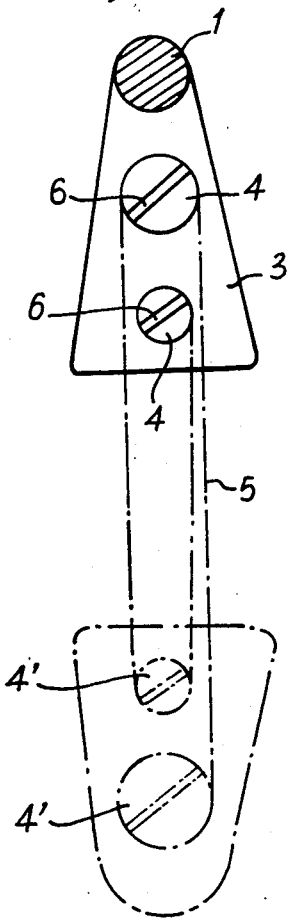
FIG. 4 is a sectional view along line IV—IV of FIG. 3.

The side branches 2,3 are connected by at least two slit stems 4 which have non aligned parallel axes, and at least one of which is longitudinally slit, with a flat flexible tie 5, shown in full lines in FIGS. 1 and 2 and in phantom lines in FIG. 4, in the shape of a strap, having at least one of its ends secured against motion by friction on the slit stem with the strap 5 penetrating the associated slot 6 and being lockingly wound on the slit stem 4, means being provided for locking said slit stem in rotation about its axis.

In FIG. 2 is shown the manner in which strap 5 is secured against motion on one of the slit stems 4. The free non treated end of strap 5 is threaded inside slot 6, following which strap 5 is wound on stem 4, for example with two or three turns, for securing the strap against motion by friction on said stem. In said FIG. 2, the other stem 4 can receive, in a manner not shown, the other end of strap 5, in the same manner, or can be used simply as a return stem for forming a shackle.

The two stems 4 extend through the side branches 2, 3 of the clevis and protrude laterally. At one of said ends, each stem 4 can be formed with a toothing 7 in the axial extension of which is provided a polygonal profile 8 for driving stem 4 in rotation. Toothing 7 co-acts with a catch 9 able to prevent the rotation of stem 4 in the unwinding direction of strap 5. At its other end, the stem 4 can extend through branch 2 via a circular bore, with a radial pin 10 for its immobilization in an axial position.

The orientation of catch 9 is such that it allows with the use of profile 8 to wind strap 5 on the associated stem 4, for securing the strap against motion or for winding it during the handling operations, and preventing the rotation in the reverse direction. If one wishes to recover the length of strap wound on said stem, the only thing to do is to put the catch 9 in an inactive position, whereby the rotation of stem 4 in the unwinding direction is possible.

If the two stems 4 are used for immobilizing each end of strap 5, each of them is fitted out with a catch 9. On the contrary, if one of said stems is used as a return stem, catch 9 is removed from it.

Figure 3:
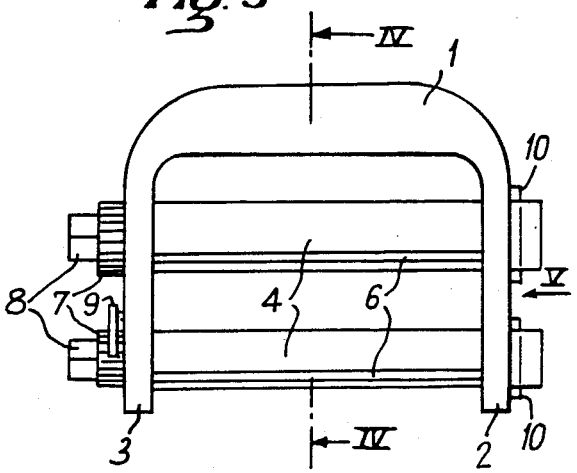
FIG. 3 is a front elevation view of a clevis according to another embodiment of the invention.
Figure 5:
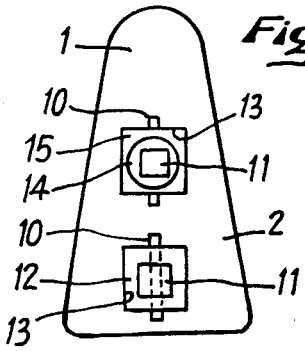
FIG. 5 is a side view in the direction of arrow V of FIG. 3.

In the embodiment of FIGS. 3 to 5, the two stems 4 are placed one on top of the other and can have different diameters, the stem of larger diameter being situated closer to the central core 1. For the rest, clevis of FIGS. 3 to 5 is similar to that of FIGS. 1 and 2.

However, an alternative embodiment for mounting the ends of stems 4 situated on the side of branch 2 is shown in FIG. 5. According to this variant, the formation of stems 4, at said end, is that of a polygonal profile 11, for example square, which can, according to needs, be left free or on the contrary locked in rotation with respect to branch 2. When a locking in rotation is required, profile 11 is received in a socket 12, with square inside and outside profiles, the square profile being received in a matching square bore 13 of branch 2.

An example of the use of the clevis according to the invention is shown in chain-dot lines in FIG. 4. In this application, two clevises of the same type are provided, placed opposite each other and in reversed positions, strap 5 being secured against motion on the stem of one of the clevises, passing on a return stem 4' of the other clevis, coming back to the return stem 4 of the first clevis, in order to be finally rigidly connected on the second stem 4' of the other clevis.

Strap 5 can be woven or obtained from a band of plastic material. For using it, it can be fed out from a reserve coil and cut to the required length, according to use. Once this length of strap is obtained, the only thing to do is to secure its ends against motion in the manner indicated above, without it being necessary to form loops or similar, necessitating for example stitched seams, for immobilizing said strap.

What I claim is:

1. A tackle comprising:

at least three stems;

a clevis device having two of said at least three stems, said two stems having non-aligned parallel axes;

a second device having at least another one of said at least three stems;

two of said at least three stems having a longitudinal slot so as to constitute slit stems;

a flat flexible strap-like tie having non-treated free ends and extending between said clevis device and said second device, each end being secured against motion by friction engagement on respective ones of said two slits stems, such that each end penetrates a respective slot and is lockingly wound on a respective slit stem, and said tie having a portion thereof between said ends which extends about at least one other stem, each of the latter functioning as a return stem; and means for defining the angular position of said two slit stems about axes thereof.

2. A tackle according to claim 1, wherein the two slit stems are carried by the same device and the return stem is carried by the other device.

3. A tackle according to claim 2, wherein one of said slit stems is carried by each of said two devices.

4. A tacke according to claim 1, wherein said means for defining the angular position includes locking means movable between an active position for preventing rotation of at least one of said two slit stems and an inactive position for permitting rotation of said at least one of said two slit stems.

5. A tackle according to claim 4, wherein the locking means is of the catch type.

6. A tackle according to claim 1, wherein said means for defining the angular position includes means for controlling rotation of at least one of said two slit stems to vary the length of said tie, and means for locking rotation of at least one of said two slit stems.

7. A tackle according to claim 6, wherein at least one of said two slit stems has an end with a polygonal configuration, and said means for controlling cooperates with said polygonal end.

8. A tackle according to claim 1, wherein said tie is obtained from a reserve coil, said tie being one of (a) woven and (b) obtained from a plastic band, and said tie has non-treated free ends.

* * * * *